US008813671B2

(12) United States Patent
Gamache et al.

(10) Patent No.: US 8,813,671 B2
(45) Date of Patent: Aug. 26, 2014

(54) WATER PARACHUTE FOR SURFACE VESSEL MOTION IMPEDANCE

(75) Inventors: Raymond M. Gamache, Indian Head, MD (US); Tyler Grigg, King George, VA (US); C. Michael Roland, Waldorf, MD (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 112 days.

(21) Appl. No.: 13/374,182

(22) Filed: Dec. 14, 2011

(65) Prior Publication Data

US 2014/0007804 A1 Jan. 9, 2014

(51) Int. Cl.
*B63B 21/48* (2006.01)

(52) U.S. Cl.
USPC ..... 114/311

(58) Field of Classification Search
USPC ..... 114/311, 244; 102/340, 378, 387, 348, 102/473
See application file for complete search history.

(56) References Cited

U.S. PATENT DOCUMENTS 2,536,682 A * 1/1951 Frieder et al. ..... 114/311
4,481,900 A * 11/1984 Rutten et al. ..... 114/311
4,534,306 A * 8/1985 Rutten et al. ..... 114/311
4,632,051 A * 12/1986 Raymond et al. ..... 114/311
4,766,837 A * 8/1988 Parish ..... 114/311
4,889,053 A * 12/1989 Grosswendt et al. ..... 102/348
4,966,079 A * 10/1990 Humphrey ..... 102/411
5,025,746 A * 6/1991 Boulter ..... 114/311
5,054,397 A * 10/1991 Hans et al. ..... 102/348
5,239,927 A * 8/1993 Frye et al. ..... 102/387
5,370,057 A * 12/1994 Badura et al. ..... 102/378
5,386,781 A * 2/1995 Day ..... 102/340
5,463,971 A * 11/1995 Abernethy ..... 114/311
H1534 H * 6/1996 Fritch ..... 102/473
5,654,521 A * 8/1997 McDaniel ..... 102/348
7,179,145 B2 * 2/2007 Driscoll et al. ..... 441/7
7,207,287 B2 * 4/2007 Beech ..... 114/311
7,374,370 B2 * 5/2008 Morris ..... 405/259.6

* cited by examiner

*Primary Examiner* — S. Joseph Morano
*Assistant Examiner* — Jovon Hayes
(74) *Attorney, Agent, or Firm* — Gerhard W. Thielman, Esq.

(57) ABSTRACT

A projectile includes an instant adhesive rubber directly connected to a high tensile strength rope and a water parachute. The projectile can be aimed at, for example, the front one-third of the vessel. Upon impact, an energetic material, such as lead azide, can be initiated to push the rubber onto the vessel and simultaneously deploy the water parachute. The parachute may be weighted to cause the parachute to submerge in the water. A tension generated by the vessel dragging the water parachute would arrest the motion and limit the speed and mobility of the vessel without significant damage to the surface vessel or occupants.

13 Claims, 1 Drawing Sheet

WATER PARACHUTE FOR SURFACE VESSEL MOTION IMPEDANCE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The invention relates to apparatus and methods for impeding motion of a water surface vessel and, more particularly, apparatus and methods for arresting the motion and limiting the speed and mobility of a water surface vessel without significantly damaging the surface vessel or occupants.

(2) Description of the Prior Art

Conventional methods and devices for arresting small surface vessels include deployable nets designed to foul the propeller mechanism of a vessel, fences, inflatable bladders and fixed barriers. While generally effective at stopping small surface craft, all are limited in terms of flexibility due to their small area of effect. Stationary barriers take time to set up, restrict both desirable and undesirable maritime traffic, and are, by nature, passive defenses. Deployable nets, either shot from some launching apparatus or dropped into the water by a boat or aircraft, have limited range, cover a limited area, and require the target vessel to collide with the nets in order to be effective.

There is a need for an improved ranged vessel arrestment system and method for arresting the motion and limiting the speed and mobility of a surface vessel.

SUMMARY OF THE INVENTION

According to one aspect of the current invention, a vessel arrestment system comprises an adhesive; a rope attached at a first end thereof to the adhesive; a water parachute attached at a second, opposite end of the rope; and a projectile housing the adhesive, rope and parachute, the projectile adapted to be externally propelled or self-propelled toward a vessel to impede its motion.

According to another aspect of the current invention, a vessel arrestment system for impeding motion of a surface vessel comprises an instant bonding adhesive; a rope attached at a first end thereof to the adhesive; a parachute attached at a second, opposite end of the rope; one or more weights attached to the water parachute; a projectile housing the adhesive, rope and parachute, the projectile adapted to be externally propelled or self-propelled toward the surface vessel; and an energetic (compressed air, sodium azide or any other chemical reaction that can produce thrust to both adhere the adhesive compound to vessel and deploy the water parachute) system to deploy the parachute from the projectile.

According to a further aspect of the current invention, a method for impeding motion of a surface vessel comprises directing a projectile toward a hull of the surface vessel; instantly bonding a first end of a rope contained in the projectile upon impact of the projectile with the hull of the surface vessel; and releasing a water parachute from the projectile, the water parachute attached to a second, opposite end of the rope.

The above and other features of the invention, including various novel details of construction and combinations of parts, will now be more particularly described with reference to the accompanying drawings and pointed out in the claims. It will be understood that the particular assembly embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent, wherein corresponding reference characters indicate corresponding parts throughout the several views of the drawings and wherein.

DETAILED DESCRIPTION OF EXEMPLARY EMBODIMENTS

The following detailed description is of the best currently contemplated modes of carrying out exemplary embodiments of the invention. The description is not to be taken in a limiting sense, but is made merely for the purpose of illustrating the general principles of the invention: the scope of the invention is best defined by the appended claims.

Broadly, the current invention provides a projectile that includes an instant adhesive rubber directly connected to a high tensile strength rope and a water parachute. (Alternatively, the properties of the rope can be designed to yield adhesion to the vessel upon contact.) The projectile can be aimed at, for example, the front one-third of the vessel. Upon impact, an energetic material, such as lead azide, can be initiated to push the rubber into the vessel and simultaneously deploy the water parachute. The parachute may be weighted to cause the parachute to submerge in the water. A tension generated by the vessel dragging the water parachute would arrest the motion and limit the speed and mobility of the vessel without significant damage to the surface vessel or occupants.

Figure 1:
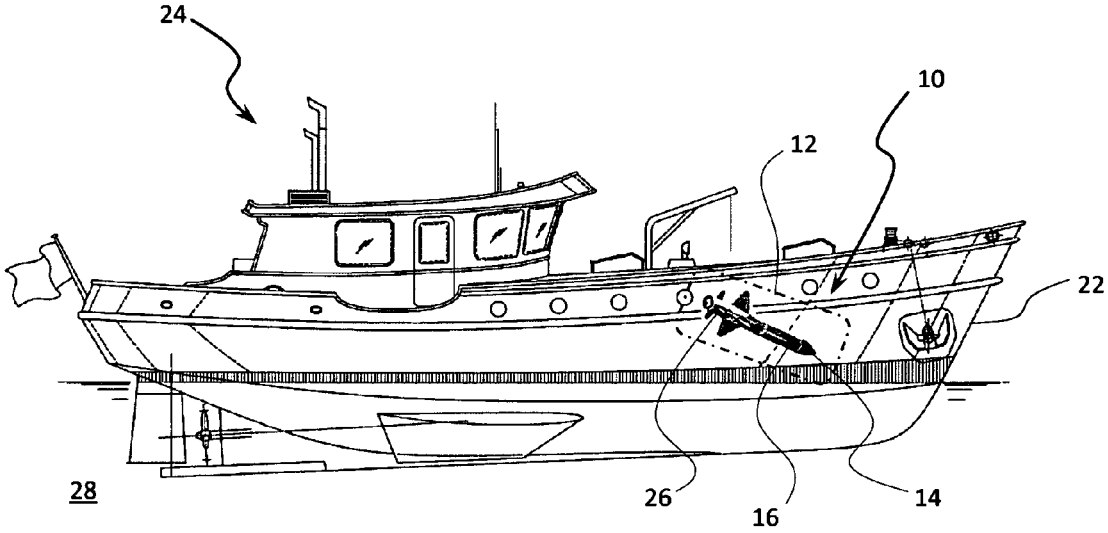
FIG. 1 is a schematic view showing a projectile housing a vessel arrestment system according to an exemplary embodiment of the current invention.
Figure 2:
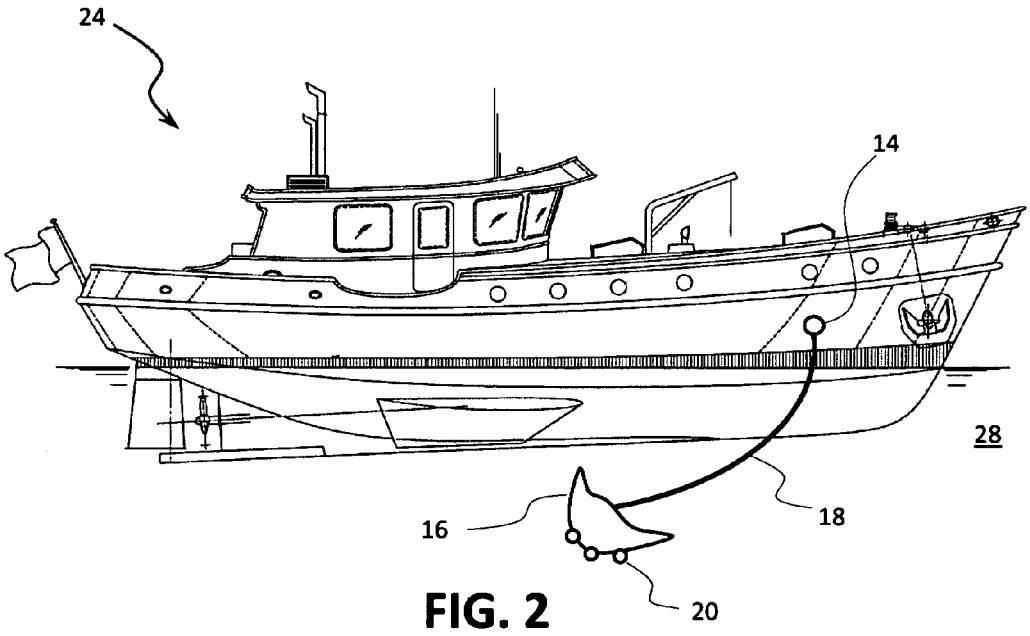
FIG. 2 is a schematic view showing the vessel arrestment system deployed on a vessel, according to an exemplary embodiment of the current invention.

Referring now to the drawings, and more particularly to FIGS. 1 and 2, a vessel arrestment system 10 may include a projectile 12 (within the dash envelope), whose payload is an adhesive 14, a weighted parachute 16, and a rope 18 connecting the adhesive 14 with the parachute 16. The rope 18 may be a high tensile strength tether, such as a Kevlar® or Spectra® rope.

The adhesive 14 may be a compounded natural rubber that provides a strong, water-impervious spontaneous bond to a hull 22 of a surface vessel 24, such as a trawler yacht as shown. A release mechanism (such as a shock-sensitive spring-mounted sabot not shown) would release (i.e., unfurl) the rope from the projectile and deploy the parachute 16, while weights 20 attached to the parachute 16 would ensure that the parachute 16 deploys clear of the propeller of the surface vessel 24. The parachute 16 may produce a constant torque on the surface vessel 24, causing a continuous change in heading while severely limiting the velocity of the vessel 24 from asymmetric drag, providing an effective mobility-kill. The projectile 12 could be either kinetic (e.g., gun-launched) or have its own propulsive mechanism 26 (e.g., rocket motor). Guidance systems (not shown) may provide a high level of accuracy, but are not necessary.

To use the projectile 12 to impede the surface vessel 24, typically a vessel that is 25 feet in length or smaller, the projectile 12 may be projected toward or self-powered toward the surface vessel 24. The impact of the projectile 12 on the hull 22 of the surface vessel 14 may cause one end of the rope 18 to be affixed to the hull 22. The energetic system may then cause the projectile 12 to disintegrate into its components, enabling the rope 18 to be released and the parachute 16 to be deployed.

The vessel arrestment system 10 may be used in, for example, security applications, such as water patrol, port security, and the like, as a non-destructive technique to slow down surface vessels.

In an alternate embodiment of the current invention, netting may be deployed by the projectile instead of the parachute. The netting may be of sufficient size and the rope may be of sufficient length to permit the netting to entangle the propeller of the vessel. In other embodiments, the projectile may include both the netting and the parachute.

While FIGS. 1 and 2 show the projectile impacting the hull of the surface vessel above the surface of the water 28, the projectile may be designed to impact the hull of the surface vessel either above or below the water line.

It will be understood that many additional changes in the details, materials, steps and arrangement of parts, which have been herein described and illustrated in order to explain the nature of the invention, may be made by those skilled in the art within the principle and scope of the invention as expressed in the appended claims.

The foregoing description of the preferred embodiments of the invention has been presented for purposes of illustration and description only. It is not intended to be exhaustive nor to limit the invention to the precise form disclosed; obviously many modifications and variations are possible in light of the above teaching. Such modifications and variations that may be apparent to a person skilled in the art are intended to be included within the scope of this invention as defined by the accompanying claims.

What is claimed is:

1. A vessel arrestment system to arrest a surface vessel on water, said system comprising:

an adhesive module for attaching to a hull of the vessel;

a rope having first and second ends attached at the first end thereof to the adhesive module;

a parachute attached at the second end of the rope; and a projectile housing the adhesive module, the rope and the parachute, wherein the projectile is launchable toward the vessel to impede its motion, the rope unfurls from the projectile and deploys the parachute into the water to induce resistive torque to the vessel.

2. The vessel arrestment system of claim 1, wherein the adhesive is a compounded natural rubber that provides an instant bond to a hull of the vessel.

3. The vessel arrestment system of claim 1, further comprising a release mechanism to deploy the rope and the parachute from the projectile.

4. The vessel arrestment system of claim 1, further comprising one or more weights on the parachute.

5. The vessel arrestment system of claim 1, further comprising a propulsion mechanism for directing the projectile toward the vessel.

6. A vessel arrestment system for impeding motion of a surface vessel on water, comprising:

a rope tether having first and second ends;

an adhesive that bonds spontaneously with a hull of the vessel, the adhesive being attached at the first end the rope tether;

a parachute attached at the second end of the rope tether opposite to the first end;

at least one weight attached to the parachute to anchor the parachute into the water;

a projectile housing the adhesive, rope and parachute, the projectile is launchable toward the surface vessel; and a release mechanism to unfurl the rope tether and deploy the parachute from the projectile to induce unsymmetrical drag to the surface vessel after the adhesive attaches to the hull.

7. The vessel arrestment system of claim 6, wherein the adhesive is a compounded natural rubber that spontaneously bonds to the hull of the surface vessel.

8. The vessel arrestment system of claim 1, further comprising a propulsion mechanism for directing the projectile toward the surface vessel.

9. A method for impeding motion of a surface vessel on water, the method comprising:

directing a projectile toward a hull of the surface vessel, the projectile containing a rope, an adhesive and a parachute;

spontaneously bonding the adhesive at a first end of the rope contained in the projectile onto the hull of the surface vessel upon contact of the projectile with the hull; and releasing a water parachute from the projectile, the water parachute attached to the second end of the rope.

10. The method of claim 9, further comprising:

weighting down the water parachute to keep the water parachute underwater once released from the projectile.

11. The method of claim 9, further comprising directing the projectile toward a front one-third of the hull of the surface vessel.

12. The method of claim 9, further comprising activating a release mechanism to unfurl the rope and deploy the water parachute from the projectile.

13. The method of claim 9, further comprising directing the projectile toward the hull of the surface vehicle with a propulsion system.

* * * * *